US006152398A

United States Patent [19]

Chen

[11] Patent Number: 6,152,398

[45] Date of Patent: Nov. 28, 2000

[54] TAPE DISPENSER

[76] Inventor: Hsiu-Man Yu Chen, No. 27, Sec 11, Ta Fu Rd., Tan Tzu Hsiang, Taichung, Taiwan

[21] Appl. No.: 09/366,777

[22] Filed: Aug. 4, 1999

[51] Int. Cl.[7] ..... B65D 85/02; B26F 3/00; B32B 31/00

[52] U.S. Cl. ..... 242/588; 242/598.3; 225/66; 225/20; 156/527

[58] Field of Search ..... 242/588, 588.3, 242/598.3, 598.5; 225/20, 56, 57, 58, 59, 65, 66, 77; 156/527, 577

[56] References Cited

U.S. PATENT DOCUMENTS 2,400,881 5/1946 Kahn .
3,404,058 10/1968 Fink .
4,915,769 4/1990 Heil et al. .
5,174,850 12/1992 Stefan .
5,490,642 2/1996 Schwartz et al. .
5,863,384 1/1999 Reddy .
5,928,466 7/1999 Yu Chen .

*Primary Examiner*—Donald P. Walsh
*Assistant Examiner*—William A. Rivera
*Attorney, Agent, or Firm*—Dogherty & Troxell

[57] ABSTRACT

A tape dispenser includes a body, a cutter base formed vertically and integral with a front portion of the bottom plate, and a tape retainer. The bottom plate has its rear portion on which a vertical post is provided integral with the bottom plate, having a free upper end. The tape retainer has a vertical semi-circular wall and a cylinder formed on an inner surface of the vertical semi-circular wall to fit around the post on the bottom plate so that the tape retainer may be rotated with the post functioning as a pivot for a certain distance back and forth. Then the tape retainer can be rotated to let the tape dispenser become a small dimensions so as to be placed in a center hollow of an adhesive tape for putting away.

4 Claims, 4 Drawing Sheets

TAPE DISPENSER

BACKGROUND OF THE INVENTION

This invention relates to a tap dispenser, particularly to one structured in such a way that an adhesive tape may be placed on or taken off easily.

A conventional tape dispenser generally has a tape retainer and a cutter holder, with a tape retained on the tape retainer and pulled to roll on a roller to be cut by a cutter fixed on the cutter holder. As the size of the tape retainer is large, it results in a rather high cost and inconvenient to put away. In addition, it is hardly put away in a drawer in a desk because of its large dimensions.

SUMMARY OF THE INVENTION

The main objective of the invention is to offer a tape dispenser collapsible to have a small dimensions to be stored away with the tape dispenser fitted in the center hollow of an adhesive tape when it is not used.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
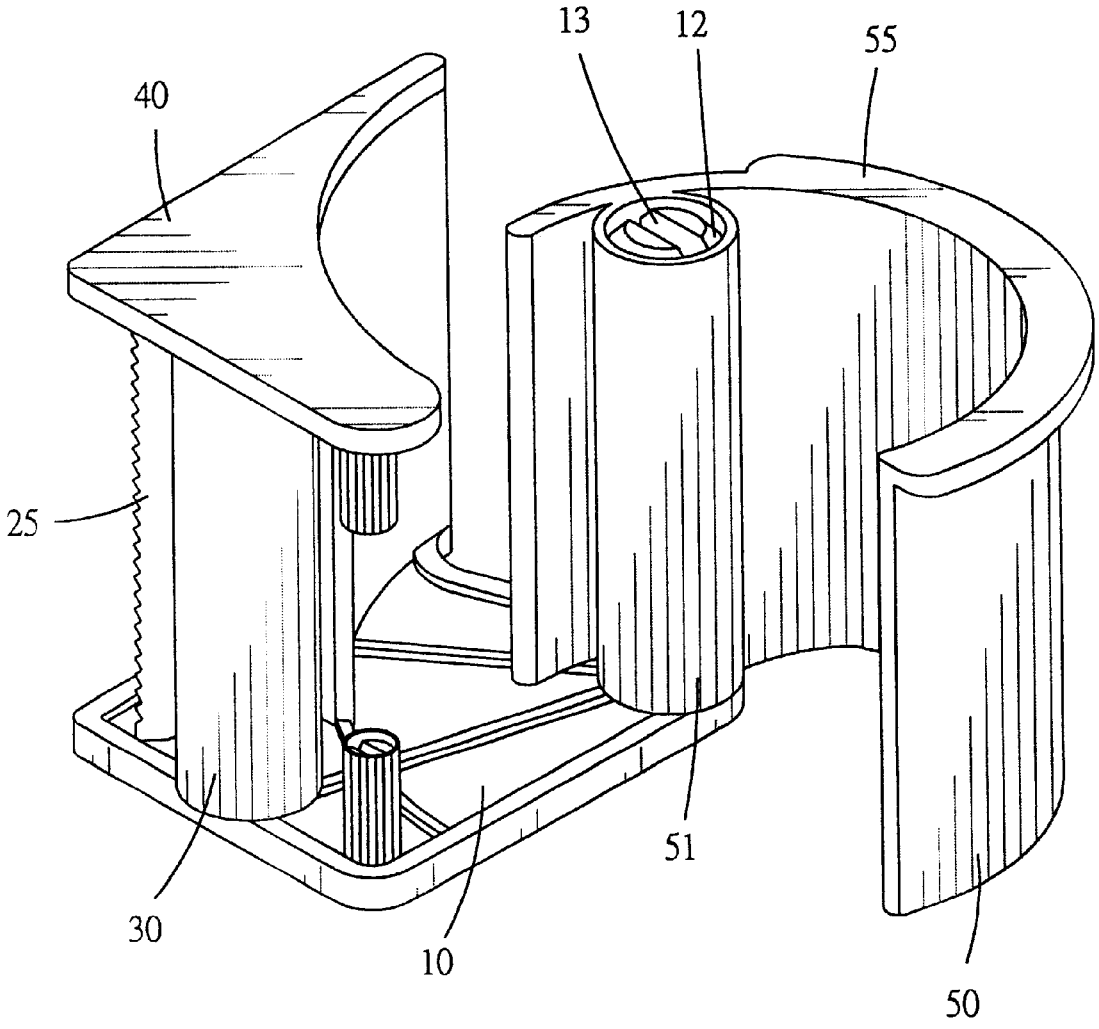
FIG. 1 is a perspective view of a tape dispenser in the present invention.
Figure 2:
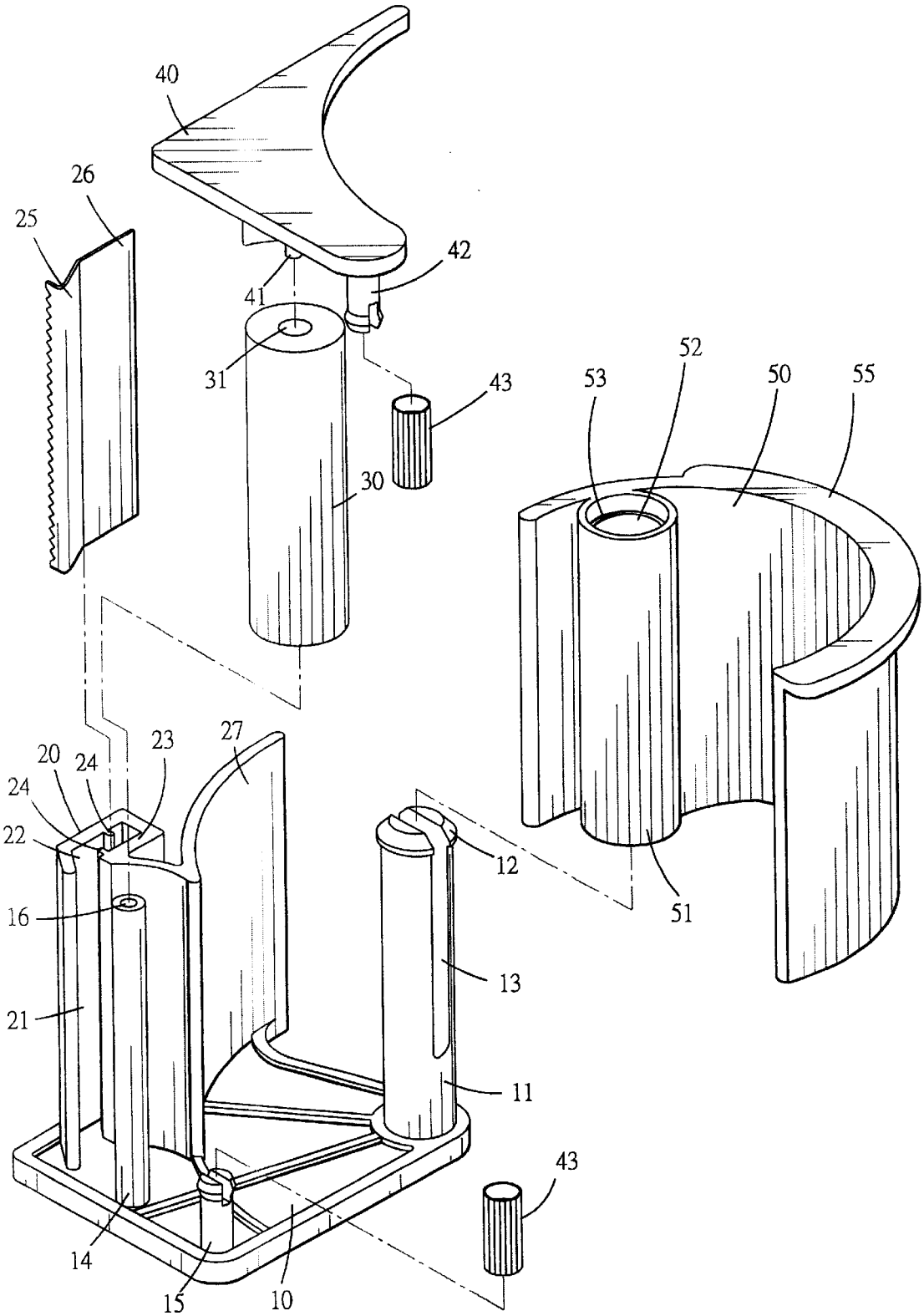
FIG. 2 is an exploded perspective view of the tape dispenser in the present invention.

A preferred embodiment of a tape dispenser in the present invention, as shown in FIG. 1, includes a bottom plate 10, a post 11, a cutter base 20, a roller 30, an upper lid 40, and a tape retainer 50 as main components combined together.

The bottom plate 10 has a front portion, on which the cutter base 20 is provided vertical, the post 11 formed integral on a rear corner of the bottom plate 1. Further, a roller shaft 14 is provided vertical behind the cutter base 20, and a first short tenon 15 provided vertical on the other corner of the rear portion.

The post 11 has two upper sloped flanges 12 and a center slot 13 formed lengthwise.

The cutter base 20 is formed integral with the bottom plate 1, having a proper height, an inner cutter groove 21 for a cutter 25 to fit therein, a long ridge 24 respectively formed on an inner surface of a front vertical wall 22 and on an inner surface of a rear vertical wall 23 to obliquely face each other so as to stop a plate portion 26 of a cutter 25, when the cutter 25 is inserted in the cutter groove 21 between the two ridges 24, 24 owing to its flexibility, and secured in the cutter base 20. Then the cutting edge of the cutter 25 is located to extend out of the cutter base 20. Further, a curved vertical tape protective wall 27 is formed behind the cutter base 20 and vertically on the bottom plate.

The roller 30 is made of rubber or the like, having a shaft hole 31 for the roller shaft 14 to extend therein to let the roller 30 rotate.

The upper lid 40 has such a shape to cover on the cutter base 20, adhered with the cutter base 20 with an adhesive or fused together by means of high frequency process. Further, the upper lid 40 has a stud 41 extending down to fit in a center hole 16 of the roller shaft 14 to secure and let the roller 30 rotate with the roller shaft 14 as a pivot, and a second short tenon 42 formed to extend down at a location in line with the first tenon 15 on the bottom plate 10 for a guide roller 43 to fit around for guiding an adhesive tape with a plurality of many parallel ridges provided on an outer surface of the guide roller 43 for the adhesive tape to stick to keep the tape from falling off.

Figure 3:
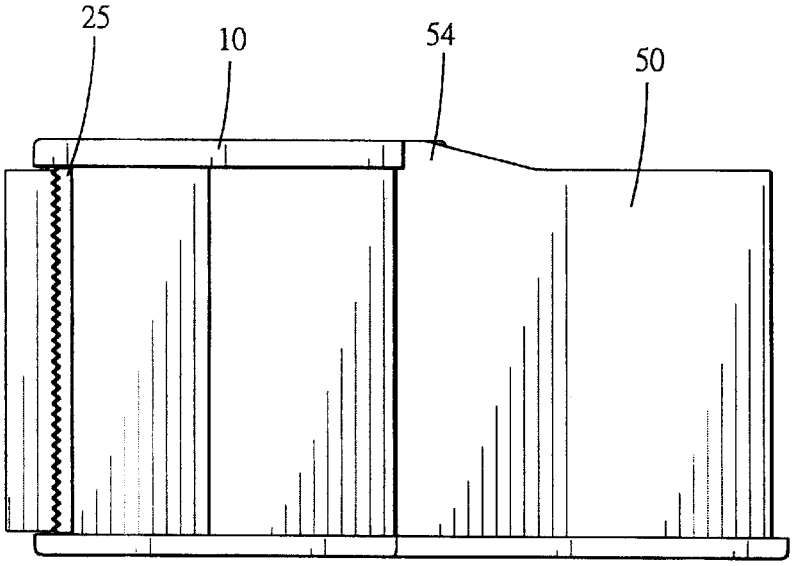
FIG. 3 is an upper view of the tape dispenser in the present invention.
Figure 4:
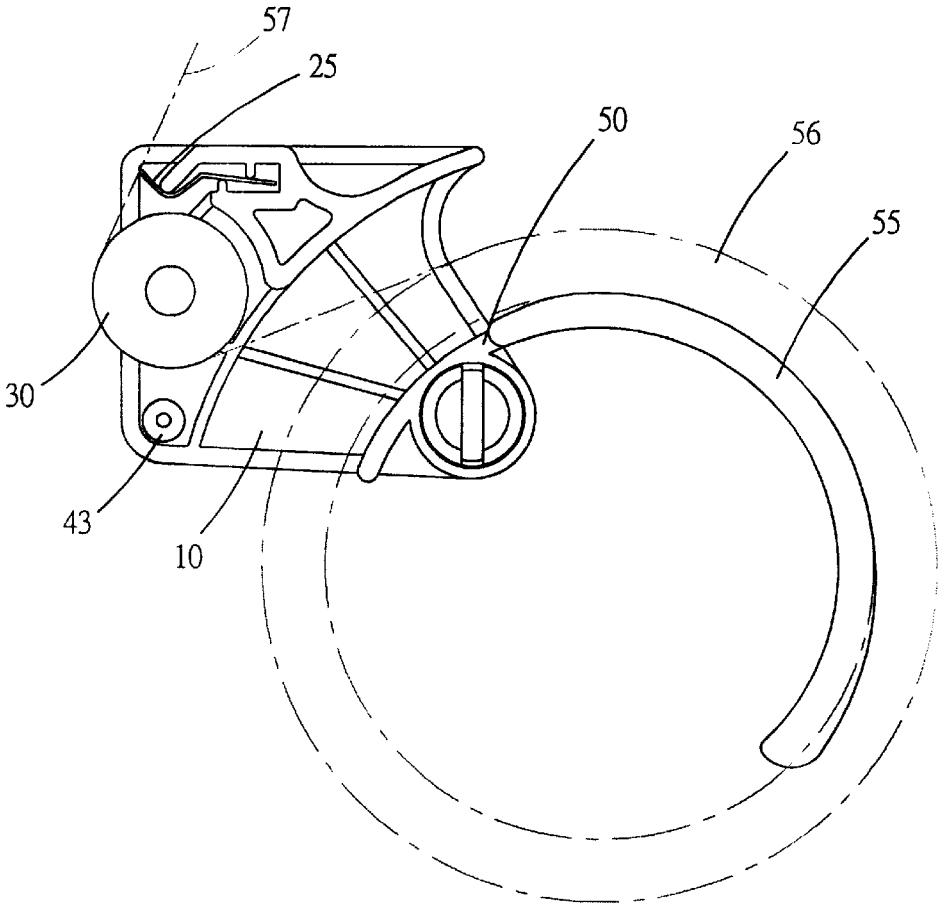
FIG. 4 is an upper view of the tape dispenser being used in the present invention; and, FIG. 5 is a perspective view of the tape dispenser placed in the center hollow of an adhesive tape.

The tape retainer 50 is shaped to have a semi-circular vertical wall, a cylinder 51 attached on an inner surface of the semi-circular wall and having a through post hole 52 to fit around the post 11. As the post 11 has the two sloped flanges 12 and the center slot 13, it may easily fit into the through post hole 52 of the cylinder 51, with the two portions divided by the center slot 13 possible to incline inward with flexibility of the material, rubber. After the post 11 fits in the post hole 52 of the cylinder 51, the two slope flanges 12 may engage a shoulder 53 formed in the through post hole 52 to secure the tape retainer 50 with the post 11. Then the tape retainer 50 may rotate with the post 11 functioning as a pivot for a certain distance. Further, as shown in FIG. 3, the tape retainer 50 has a stop surface 54 formed to protrude from a front end of the semi-circular vertical wall to be stopped at a rear edge of the bottom plate 10, no longer able to rotate further. The tape retainer 50 further has a curved stop flat wall 55 formed on top of the semi-circular vertical wall.

Next, how to use the tape dispenser in the invention is to be described here. as shown in FIGS. 1 and 3, the stop surface 54 of the tape retainer 30 is stopped at the rear side edge of the bottom plate 10, unable to rotate further. Then a roll of an adhesive tape 56 is placed around and stopped by the semi-circular outer wall 55 of the tape retainer 50. Then the free end of the adhesive tape 56 is pulled out and extended on and over the roller 30 for use.

Figure 5:
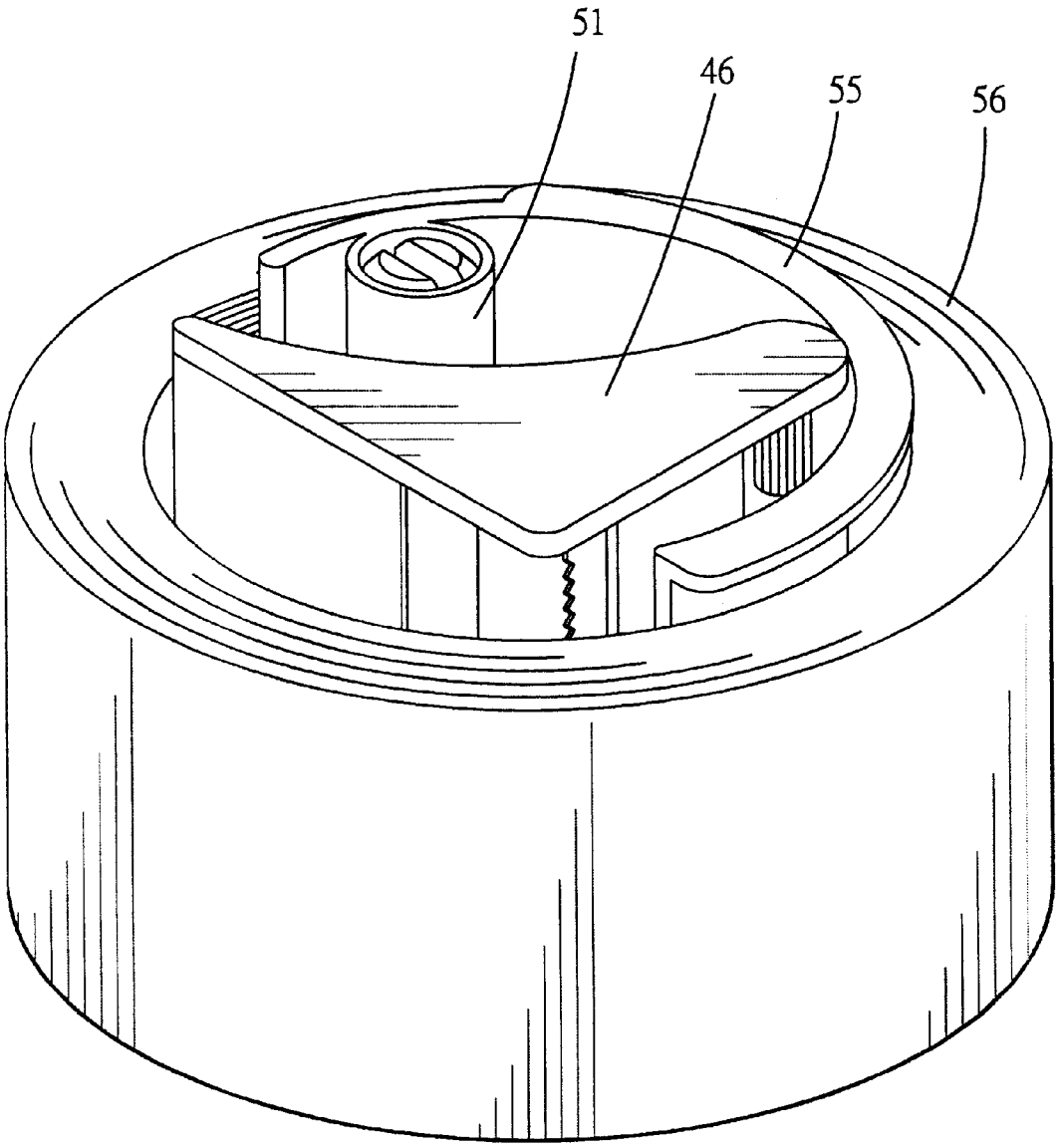

When the tape dispenser is not to be used and wanted to be put away, the adhesive tape 56 is taken out of the tape dispenser, and as shown in FIG. 5, with the tape retainer 50 can be rotated with the post 11 as a pivot to let the tape dispenser have a small dimension, and then placed in a center hollow of the adhesive tape 56 to be put away.

The provision of the two sloped flanges 12 and the center slot 13 of the post 11 enables the post 11 to be easily assembled with the cylinder 51 of the tape retainer 50 and secured by the shoulder 53 so as to permit the tape retainer 50 rotate with the post 11 as a pivot, and largely cut down the cost of the tape dispenser.

While the preferred embodiment of the invention has been described above, it will be recognized and understood that various modifications may be made therein and the appended claims are intended to cover all such modifications which may fall within the spirit and scope of the invention.

What is claimed is:

1. A tape dispenser comprising a bottom plate, a cutter base formed integral on a front portion of said bottom plate, and a tape retainer combined together with said bottom plate;

said bottom plate having a rear portion on which a post formed integral to stand and having an upper free end;

said tape retainer having its front inner surface pivotally connected to said post on said bottom plate so that said tape retainer may be rotated with said post as a pivot for a predetermined distance back and forth.

2. The tape dispenser as claimed in claim 1, wherein said tape retainer has a cylinder formed vertical on said front inner surface, and said cylinder has a center through post hole fitting around said post on said bottom plate.

3. The tape dispenser as claimed in claim 1, wherein said post on said bottom plate has two semi-circular sloped flanges formed on said free upper end, and a center lengthwise slot, said two sloped flanges engaging a shoulder provided in said through post hole of said cylinder of said tape retainer.

4. The tape dispenser as claimed in claim 1, wherein said tape retainer has a vertical semi-circular wall, and a stop surface formed to protrude from a front end of said vertical semi-circular wall, said stop surface stopped by a rear end edge of said bottom plate when said tape retainer is rotated with said post of said bottom plate functioning as a pivot.

* * * * *